US005678586A

United States Patent [19]

Baksh

[11] Patent Number: 5,678,586

[45] Date of Patent: Oct. 21, 1997

[54] UMBRELLA FOR ALLEVIATING WIND GUST

[76] Inventor: Fareed Baksh, 132-12 101st Ave., Richmond Hill, N.Y. 11419

[21] Appl. No.: 664,196

[22] Filed: Jun. 10, 1996

[51] Int. Cl.[6] ..... A45B 25/30

[52] U.S. Cl. ..... 135/33.7; 135/28; 135/33.5; 135/40

[58] Field of Search ..... 135/33.7, 33.71, 135/33.2, 33.41, 33.5, 32, 28, 40, 29

[56] References Cited

U.S. PATENT DOCUMENTS

| | | | |
|---|---|---|---|
| 321,855 | 7/1885 | Richards | 135/33.5 |
| 874,799 | 12/1907 | Schroeder | 135/32 |
| 1,220,565 | 3/1917 | Schlesinger | 135/28 |
| 1,405,824 | 2/1922 | Evans | 135/32 |
| 3,374,798 | 3/1968 | Samuelson | 135/33.7 |
| 3,456,661 | 7/1969 | Farley | 135/33.7 |
| 5,144,970 | 9/1992 | Seidel et al. | 135/28 |

FOREIGN PATENT DOCUMENTS

| | | | |
|---|---|---|---|
| 392568 | 11/1908 | France | 135/33.7 |
| 692497 | 11/1930 | France | 135/33.7 |
| 817056 | 8/1937 | France | 135/33.7 |
| 4511 | of 1879 | United Kingdom | 135/33.7 |

*Primary Examiner*—Carl D. Friedman
*Assistant Examiner*—Winnie Yip
*Attorney, Agent, or Firm*—Michael I. Kroll

[57] ABSTRACT

An improved umbrella (16) for alleviating wind gust (14) comprising an elongated shaft (18) having a handle (20) to be grasped by a hand (22) of a person (10). A collapsible main canopy (24) is carried on the elongated shaft (18). A facility (26) in the collapsible main canopy (24), is for exiting the wind gust (14) out through the top of the collapsible main canopy (24), rather than becoming trapped air which can turn a conventional umbrella (12) inside out. A smaller collapsible auxiliary canopy (28) is carried on the elongated shaft (18) over the wind gust exiting facility (26) in the collapsible main canopy (24), to help prevent rain drops from entering in through the wind gust exiting facility (26).

1 Claim, 4 Drawing Sheets

UMBRELLA FOR ALLEVIATING WIND GUST

BACKGROUND OF THE INVENTION

1. Field of the Invention

The instant invention relates generally to umbrellas and more specifically it relates to an improved umbrella for alleviating wind gust.

2. Description of the Prior Art

Numerous umbrellas have been provided in prior art that are adapted to protect people and objects from the weather, with each umbrella consisting of a collapsible canopy mounted on a central rod. While these units may be suitable for the particular purpose to which they address, they would not be as suitable for the purposes of the present invention as heretofore described.

SUMMARY OF THE INVENTION

A primary object of the present invention is to provide an improved umbrella for alleviating wind gust that will overcome the shortcomings of the prior art devices.

Another object is to provide an improved umbrella for alleviating wind gust that will allow a wind gust to exit through a top aperture in a fabric covering of a main canopy, rather than becoming trapped air which can turn a conventional umbrella inside out.

An additional object is to provide an improved umbrella for alleviating wind gust, in which a smaller auxiliary canopy over the top aperture in the fabric covering of the main canopy will help prevent rain drops from entering in through the top aperture.

A further object is to provide an improved umbrella for alleviating wind gust that is simple and easy to use.

A still further object is to provide an improved umbrella for alleviating wind gust that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
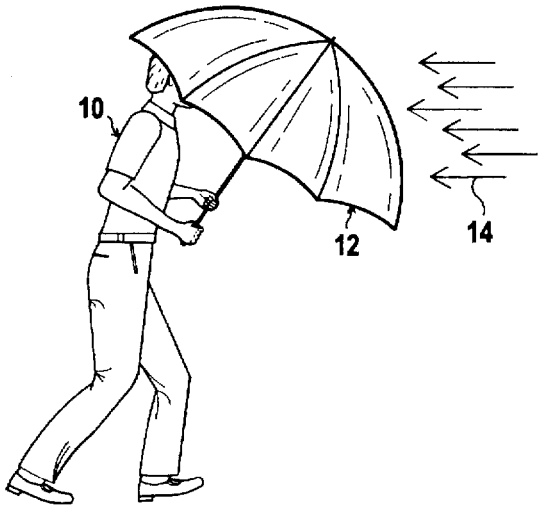
FIG 1 ( PRIOR ART )
FIG. 1 is a side view of the prior art, showing a person carrying a conventional umbrella tipped into a wind gust.
Figure 2:
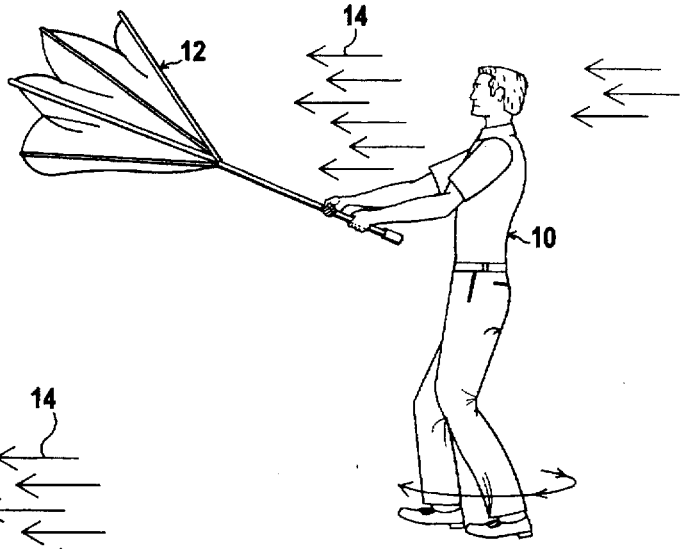
FIG 2 ( PRIOR ART )
FIG. 2 is a side view of the prior art, showing the person spinning around and the conventional umbrella turned inside out by the wind gust.

Turning now descriptively to the drawings, in which similar reference characters denote similar elements throughout the several views, FIG. 1 illustrates the prior art, in which a person 10 is carrying a conventional umbrella 12 tipped into a wind gust 14. In FIG. 2 of the prior art, the person 10 is spinning around and the conventional umbrella 12 is being turned inside out by the wind gust 14.

The instant invention as shown in FIGS. 3 through 8, is an improved umbrella 16 for alleviating wind gust 14, comprising an elongated shaft 18 having a handle 20 to be grasped by a hand 22 of the person 10. A collapsible main canopy 24 is carried on the elongated shaft 18. A facility 26 in the collapsible main canopy 24, is for exiting the wind gust 14 out through the top of the collapsible main canopy 24, rather than becoming trapped air which can turn the conventional umbrella 12 inside out. A smaller collapsible auxiliary canopy 28 is carried on the elongated shaft 18 over the wind gust exiting facility 26 in the collapsible main canopy 24, to help prevent rain drops from entering in through the wind gust exiting facility 26.

Figure 4:
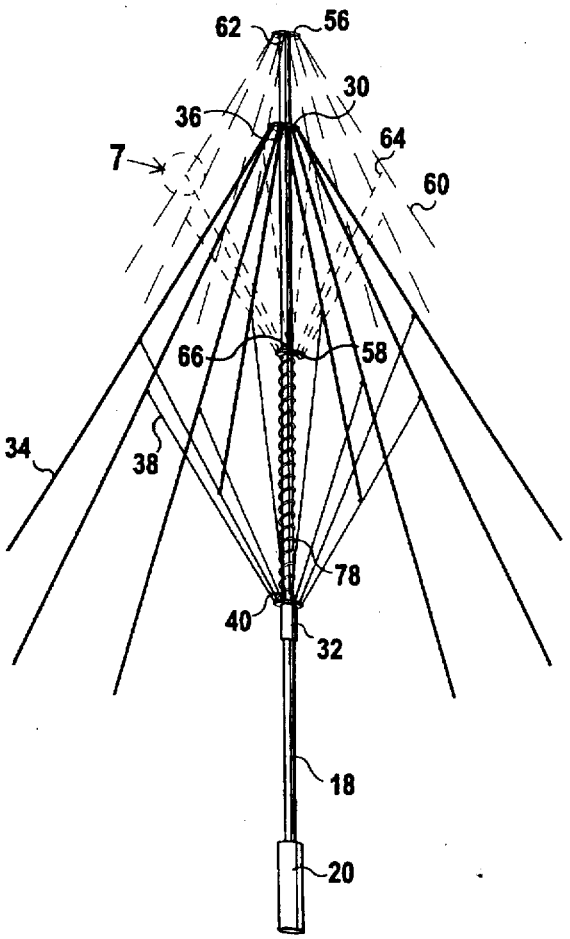
FIG. 4 is a bottom perspective view of the instant invention per se partly closed with the fabric coverings of the main canopy and the smaller auxiliary canopy removed therefrom.
Figure 6A:
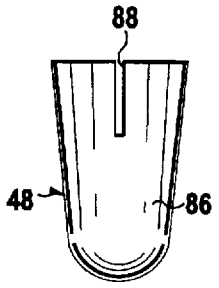
FIG. 6A is a side view of the main tip member per se taken in the direction of arrow 6A in FIG. 6.
Figure 6:
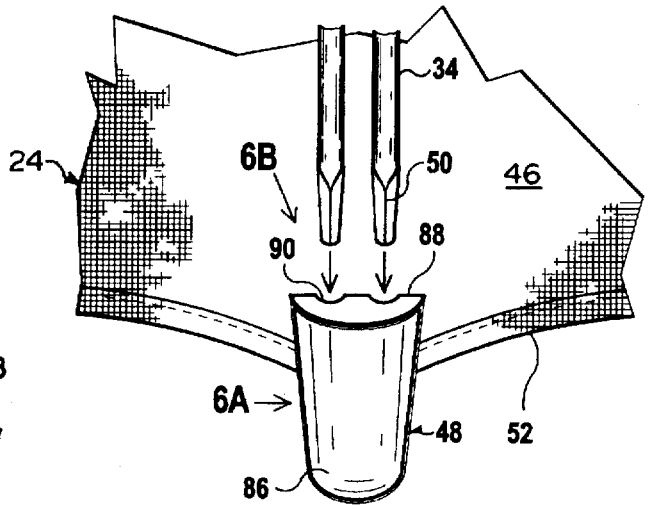
FIG. 6 is an enlarged top perspective view of the area indicated by arrow 6 in FIG. 5.
Figure 6B:
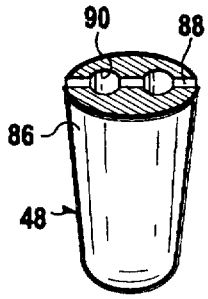
FIG. 6B is a top perspective view of the main tip member per se taken in the direction of arrow 6B in FIG. 6.
Figure 8:
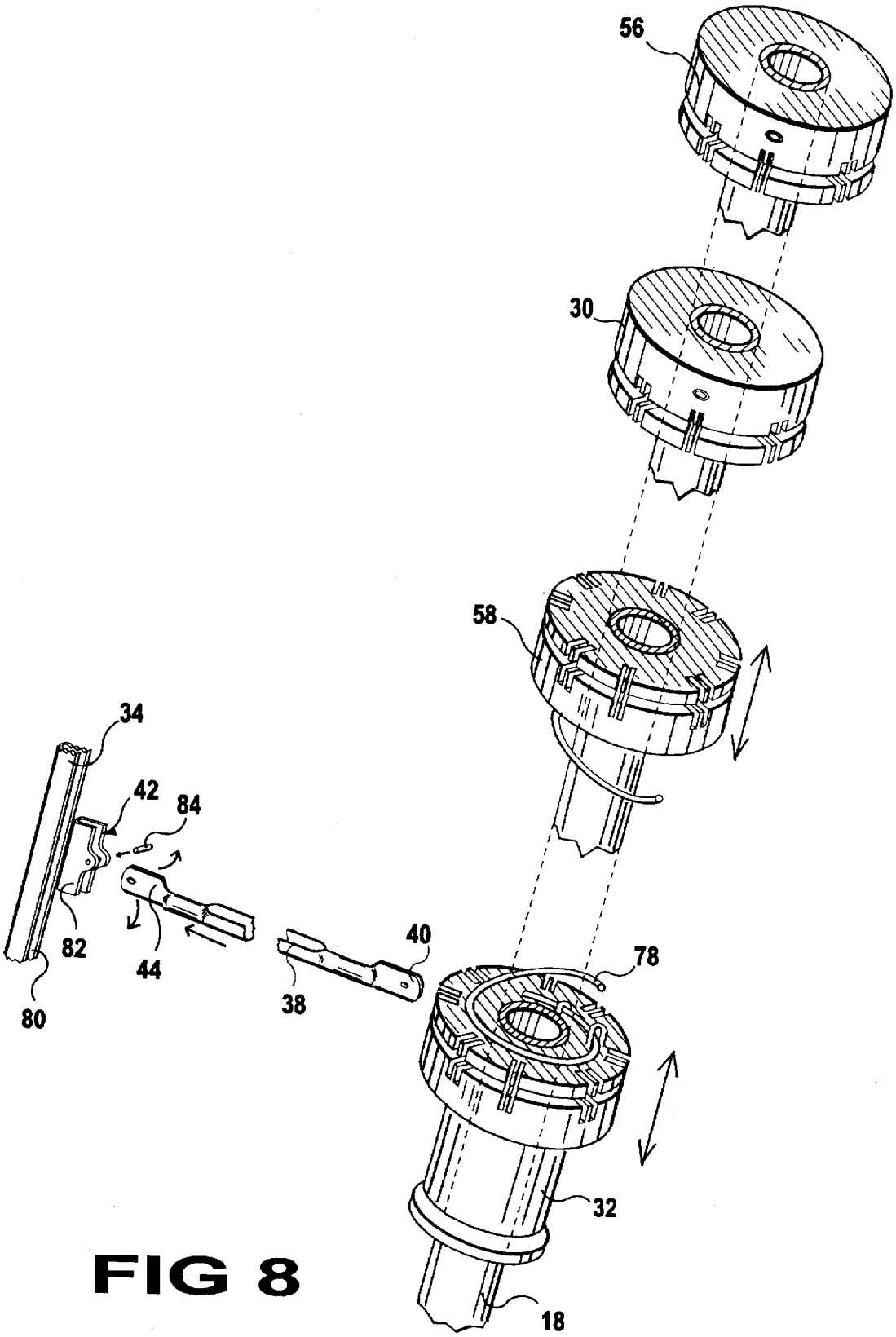
FIG. 8 is an enlarged perspective view, with parts broken away in section and partly exploded of some of the various components on the elongated shaft.

The collapsible main canopy 24, as best seen in FIGS. 4 and 8, includes a main inside cap 30 affixed to the elongated shaft 18. A main runner 32 rides on the elongated shaft 18. A plurality of main ribs 34 are provided. Each main rib 34 is pivotally affixed at a first end 36 and radially extends about the main inside cap 30. A plurality of main stretchers 38 are also provided. Each main stretcher 38 is pivotally affixed at a first end 40 and radially extends about the main runner 32. A structure 42 is for pivotally attaching a second end 44 of each main stretcher 38 approximately midway to each main rib 34. A main fabric covering 46 is affixed to the main ribs 34. A component 48, as shown in FIGS. 6, 6A and 6B, is for retaining a second end 50 of each main rib 34 to a bottom edge 52 of the main fabric covering 46.

Figure 3:
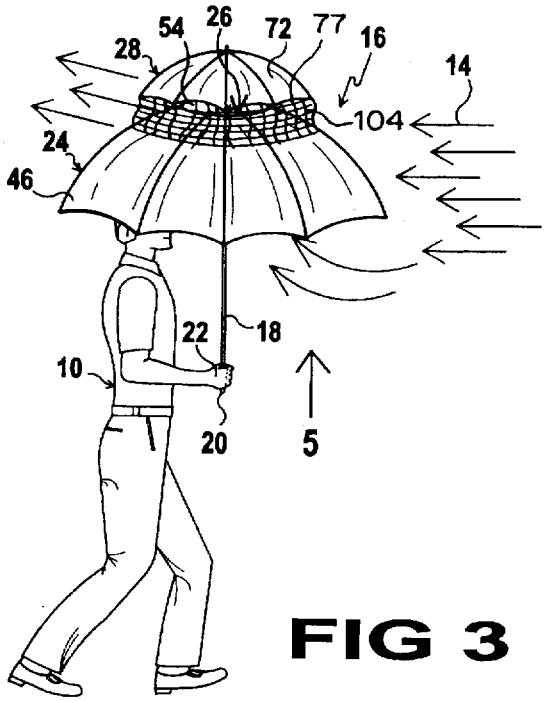
FIG. 3 is a side view of a person carrying the instant invention upright in the wind gust.
Figure 5:
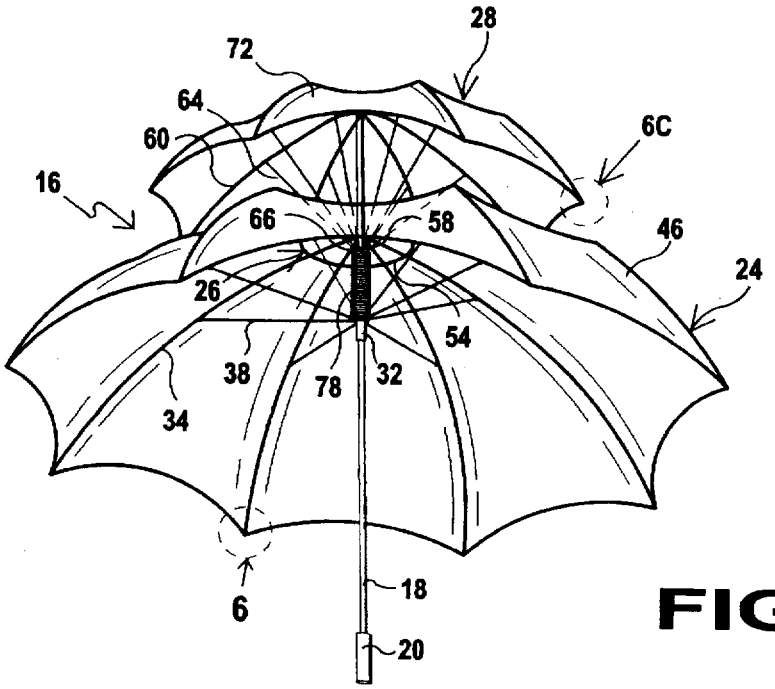
FIG. 5 is a bottom perspective view of the instant invention per se taken in the direction of arrow 5 in FIG. 3.

The wind gust exiting facility 26, as shown in FIGS. 3 and 5, consists of the main fabric covering 46 having a top aperture 54. The elongated shaft 18 extends through a center of the top aperture 54, so that the wind gust 14 can pass through the top aperture 54.

The smaller collapsible auxiliary canopy 28 comprises an auxiliary inside cap 56 affixed near the top end of the elongated shaft 18 and is spaced above the main inside cap 30. An auxiliary runner 58 rides on the elongated shaft 18, between the main inside cap 30 and the main runner 32. A plurality of auxiliary ribs 60 are provided. Each auxiliary rib 60 is pivotally affixed at a first end 62 and radially extends about the auxiliary inside cap 56.

A plurality of auxiliary stretchers 64 are also provided. Each auxiliary stretcher 64 is pivotally affixed at a first end 66 and radially extends about the auxiliary runner 58. A structure 68 is for pivotally attaching a second end 70 of each auxiliary stretcher 64 approximately midway to each auxiliary rib 60. An auxiliary fabric covering 72 is affixed to the auxiliary rib 60. A component 74 is for retaining a second end 76 of each auxiliary rib 60 to a bottom edge 77 of the auxiliary fabric covering 72.

A helical compression spring 78 is on the elongated shaft 18. The spring 78 is affixed to and extends between the main runner 32 and the auxiliary runner 58. The spring 78 will maintain a proper distance between the main runner 32 and the auxiliary runner 58, when the collapsible main canopy 24 and the smaller collapsible auxiliary canopy 28 are opened and closed simultaneously together.

Each first pivotally attaching structure 42 includes the main rib 34 having a longitudinal groove 80 therealong. A main U-shaped joint insert 82 snugly fits into the longitudinal groove 80 in the main rib 34. A main pin 84 extends through the main U-shaped joint insert 82 and the second end 44 of the main stretcher 38 (see FIG. 8).

Each first retaining component 48 is a main tip member 86 having a top slot 88 with at least one top socket 90. The bottom edge 52 of the main fabric covering 46 can snugly fit into the top slot 88. The second end 50 of the main rib 34 can snugly fit into the at least one top socket 90 in the main tip member 86.

Figure 7:
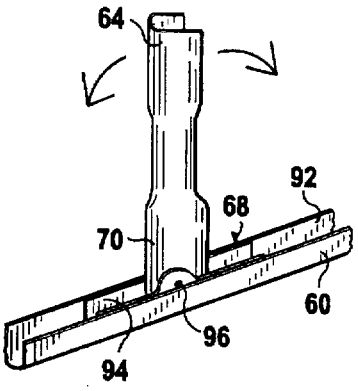
FIG. 7 is an enlarged assembled perspective view of the area indicated by arrow 7 in FIG. 4.
Figure 7A:
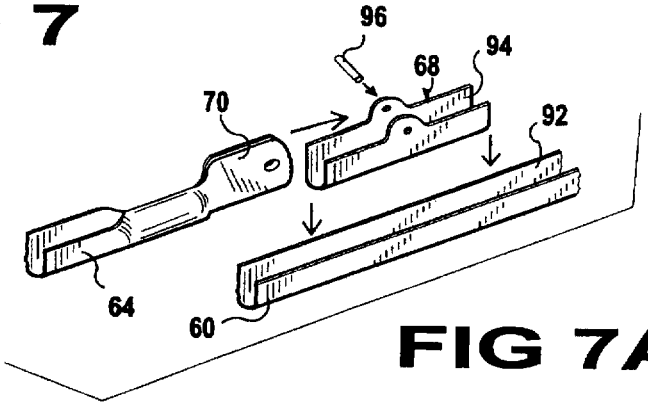
FIG. 7A is an exploded perspective view of FIG. 7.

Each second pivotally attaching structure 68 consists of the auxiliary rib 60 having a longitudinal groove 92 therealong. An auxiliary U-shaped joint insert 94 snugly fits into the longitudinal groove 92 in the auxiliary rib 60. An auxiliary pin 96 extends through the auxiliary U-shaped joint insert 94 and the second end 70 of the auxiliary stretcher 64 (see FIGS. 7 and 7A).

Figure 6C:
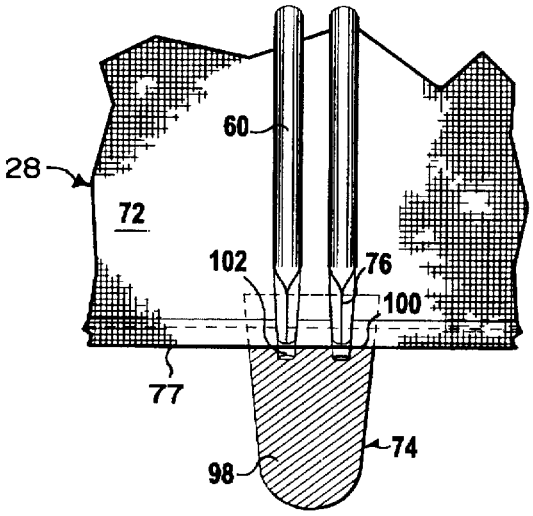
FIG. 6C is an elevational view of the area indicated by arrow 6C in FIG. 6, with the auxiliary tip member in cross section.

Each second retaining component 74, as shown in FIG. 6C, is an auxiliary tip member 98 having a top slot 100 with at least one top socket 102. The bottom edge 77 of the auxiliary fabric covering 72 can snugly fit into the top slot 100. The second end 76 of the auxiliary rib 60 can snugly fit into the at least one top socket 102 in the auxiliary tip member 98.

A mesh skirt 104, as shown in FIG. 3, can be attached to and extend from the bottom edge 77 of the smaller collapsible auxiliary canopy 28 to the collapsible main canopy 24 about the wind gust exiting facility 26, by being sewn or held thereto by VELCRO. The mesh skirt 104 will additionally help prevent rain drops from entering in through the wind gust exiting facility 26 and for holding and strengthening the smaller collapsible auxiliary canopy 28 to the collapsible main canopy 24 during high winds.

The collapsible main canopy 24 can contain single main ribs 34 and single main stretchers 38, as shown in FIGS. 4 and 5, or double main ribs 34 and double main stretchers 38, as indicated in FIG. 6. The smaller collapsible auxiliary canopy 28 can contain single auxiliary ribs 60 and single auxiliary stretchers 64, as shown in FIGS. 4 and 5, or double auxiliary ribs 60 and double auxiliary stretchers 64, as indicated in FIG. 6C.

LIST OF REFERENCE NUMBERS

10—person
12—conventional umbrella (prior art)
14—wind gust
16—improved umbrella
18—elongated shaft of 16
20—handle on 18
22—hand of 10
24—collapsible main canopy of 16
26—wind gust exiting facility in 24
28—smaller collapsible auxiliary canopy of 16
30—main inside cap of 24
32—main runner of 24
34—main rib of 24
36—first end of 34
38—main stretcher of 24
40—first end of 38
42—first pivotally attaching structure of 24
44—second end of 38
46—main fabric covering of 24
48—first retaining component of 24
50—second end of 34
52—bottom edge of 46
54—top aperture for 26
56—auxiliary inside cap of 28
58—auxiliary runner of 28
60—auxiliary rib of 28
62—first end of 60
64—auxiliary stretcher of 28
66—first end of 64
68—second pivotally attaching structure of 28
70—second end of 64
72—auxiliary fabric covering of 28
74—second retaining component of 28
76—second end of 60
77—bottom edge of 72
77—helical compression spring on 18
80—longitudinal groove in 34
82—main U-shaped joint insert of 42
84—main pin of 42
86—main tip member for 48
88—top slot in 86
90—top socket in 86
92—longitudinal groove in 60
94—auxiliary U-shaped joint insert of 68
96—auxiliary pin of 68
98—auxiliary tip member for 74
100—top slot in 98
102—top socket in 98
104—mesh skirt between 24 and 28

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An umbrella for alleviating wind gust comprising:

a) an elongated shaft having a handle adapted to be grasped by a hand of a person;

b) a collapsible main canopy of fabric material carried on said elongated shaft;

c) a wind gust exiting opening is formed in said collapsible main canopy for exiting the wind gust out through a top of said collapsible main canopy, rather than becoming trapped air which can turn a conventional umbrella inside out;

d) a smaller collapsible auxiliary canopy of fabric material carried on said elongated shaft over and above said opening in said collapsible main canopy to help prevent rain drops from entering through said wind gust exiting means, said auxiliary canopy being spaced from and unattached to said main canopy;

e) means for supporting and deploying said collapsible main canopy comprising a main inside cap affixed to said elongated shaft, a plurality of main ribs with each said main rib pivotally affixed at a first end to and radially extending from said main inside cap forming a frame for said main canopy and with the second end of each main rib attached to said main canopy, a main runner which rides on said elongated shaft below said main inside cap, a plurality of main stretchers with each main stretcher pivotally affixed at one end for and radially extending from said main runner and means for pivotally attaching a second end of each said main stretcher to about a midway point on each said main rib, said main canopy affixed to said main ribs with means for retaining a second end of each said main rib to a bottom edge of said main canopy;

f) means for supporting and deploying said collapsible auxiliary canopy comprising an auxiliary inside cap affixed near a top end of said elongated shaft and spaced above said main inside cap, an auxiliary runner riding on said elongated shaft between said main inside cap and said main runner, a plurality of auxiliary ribs each pivotally affixed at a first end to and radially extending from said auxiliary inside cap, a plurality of auxiliary stretchers each pivotally affixed at a first end to and radially extending from said auxiliary runner, means for pivotally attaching a second end of each said auxiliary stretcher approximately midway to each said auxiliary rib, and means for retaining a second end of each said auxiliary rib to a bottom edge of said auxiliary fabric canopy;

g) a helical compression spring on said elongated shaft, said spring being affixed to and extendinding between said main runner and said auxiliary runner, said spring maintaining a variable distance between said main runner and said auxiliary runner when said collapsible main canopy and said smaller collapsible auxiliary canopy are opened and closed simultaneously, said spring becoming compressed as said main runner is pushed to deploy both said canopies; and h) a mesh skirt attached to and extending from a bottom circumferential edge of said smaller collapsible auxiliary canopy to said collapsible main canopy fully extending about and surrounding said wind gust exiting opening to additionally help prevent rain drops from entering in through said opening and for holding said smaller collapsible auxiliary canopy to said collapsible main canopy during high winds.

* * * * *